United States Patent [19]

Kaufmann

[11] 4,060,102

[45] Nov. 29, 1977

[54] HEDDLE FRAMES

[75] Inventor: Frank H. Kaufmann, Greenville, S.C.

[73] Assignee: Steel Heddle Manufacturing Company, Greenville, S.C.

[21] Appl. No.: 731,736

[22] Filed: Oct. 12, 1976

[51] Int. Cl.[2] ..... D03C 9/06

[52] U.S. Cl. ..... 139/91

[58] Field of Search ..... 139/91, 92, 82

[56] References Cited

U.S. PATENT DOCUMENTS

| | | | |
|---|---|---|---|
| 993,685 | 5/1911 | Holmes | 139/91 |
| 3,796,235 | 3/1974 | Muller | 139/91 X |
| 3,901,282 | 8/1975 | Kramer et al. | 139/92 |

*Primary Examiner*—James Kee Chi

*Attorney, Agent, or Firm*—Zachary T. Wobensmith, 2nd; Zachary T. Wobensmith, III

[57] ABSTRACT

A heddle frame for looms for weaving is provided having a readily attachable and removable brace for the frame intermediate its ends for preventing distortion of the top and bottom rails, the brace being of synthetic plastic material and/or metal with connectors at the top and bottom. The brace is particularly adapted for heddle frames which are supported and actuated by the bottom rail.

8 Claims, 7 Drawing Figures

HEDDLE FRAMES

BACKGROUND OF THE INVENTION

1. Field of the Invention

This invention relates to heddle frame for looms and more particularly to an improved brace for the frame intermediate its ends.

2. Description of the Prior Art

It has heretofore been proposed as shown in the U.S. Patent to Pfarrwaller, U.S. Pat. No. 2,700,399 to provide braces or posts intermediate the ends of the heddle frame with upper and lower metal frame bars, the posts extending into the frame bars and being secured by rivets. The posts were entirely within the confines of the frame and supported detachable heddle carrier rails or bars insertable and removable in sections for insertion or removal of the heddle in groups.

It has also heretofore been proposed as in the U.S. Patent to J. J. Kaufmann, U.S. Pat. No. 2,909,199 and to F. H. Kaufmann U.S. Pat. No. 3,241,575 to employ stay rods or braces for top and bottom wooden rails of a harness frame.

The stay rods and braces of these and similar structures were at fixed locations and did not serve any purpose of preventing abrasion of adjoining heddle frames.

In the Pfarrwaller structure, also, the riveting in place of the posts and the application of stresses on the metal rails at the location of the rivets tended to weaken the frame.

It has heretofore been proposed as in the U.S. Patent to F. H. Kaufmann et al., U.S. Pat. No. 3,470,920 and to Charles F. Kramer et al., U.S. Pat. No. 3,901,282, to provide easily removable supports for the heddle carrying rails which embraced the top and bottom rails and provided spaces for adjoining heddle frames upon their vertical movements in shedding.

None of the prior art structures provide the versatility in a brace for harness frames of the present structure.

SUMMARY OF THE INVENTION

In accordance with the present invention, a brace for heddle frames is provided for use intermediate the ends of the top and bottom frame rails which embraces the rails, is readily attachable and snapped in place and which spaces and prevents abrasion of adjoining heddle frame during shedding.

It is the principal object of the invention to provide an improved brace for the top and bottom rails of a heddle frame which embraces the rails and which prevents abrasion of adjoining heddle frames during shedding.

It is a further object of the invention to provide an improved brace for the top and bottom rails of a heddle frame which is sturdy yet light in weight and which can be readily secured in place on the rails.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which.

Figure 1:
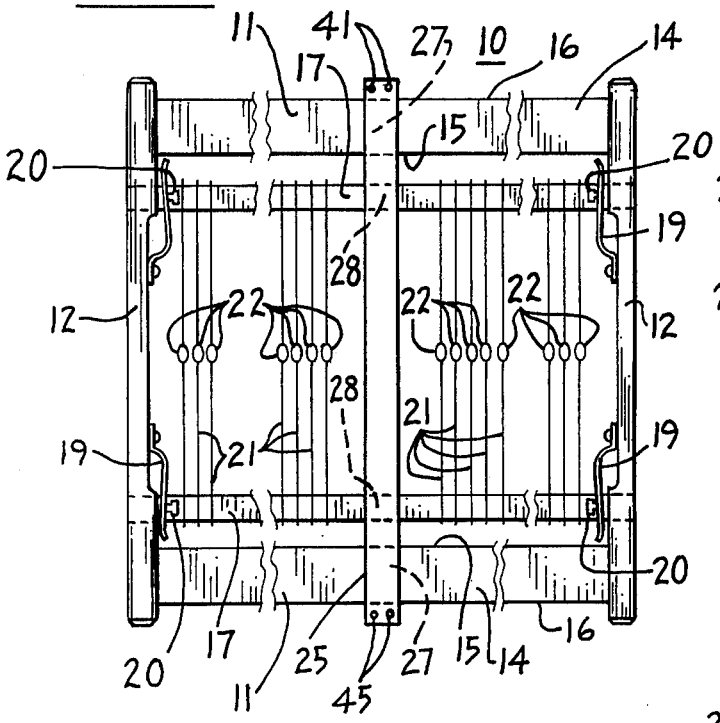
FIG. 1 is a view in front elevation of a heddle frame having a brace in accordance with the invention mounted thereon.
Figure 2:
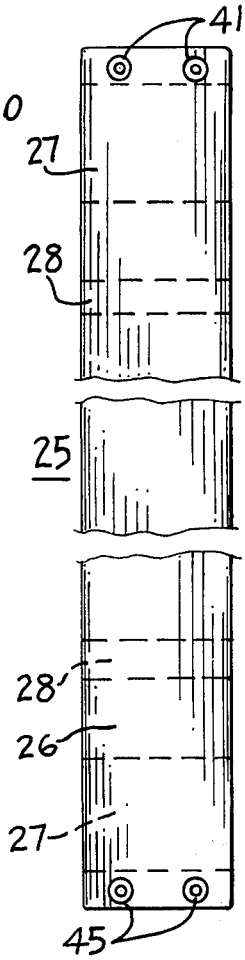
FIG. 2 is a front elevational view, on a larger scale, of the brace.
Figure 3:
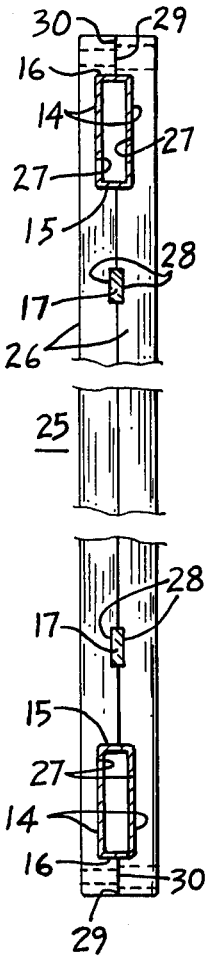
FIG. 3 is a side elevational view of the brace shown in FIG. 2.
Figure 4:
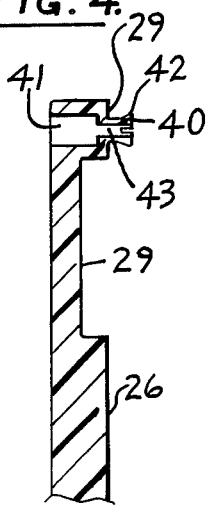
FIG. 4 is a vertical sectional view taken approximately on the line 4—4 of FIG. 5, and showing a clamping element for retaining the brace in position.
Figure 5:
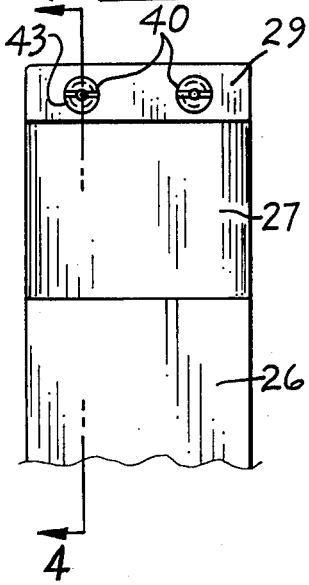
FIG. 5 is a view in elevation of the one end of one component of the brace as seen from the interior.
Figure 6:
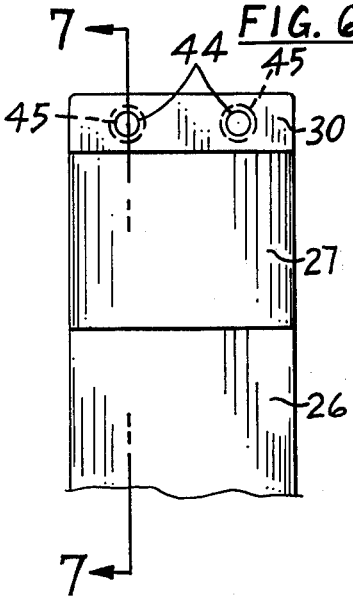
FIG. 6 is a view in elevation of one end of the other component of the brace as seen from the interior.
Figure 7:
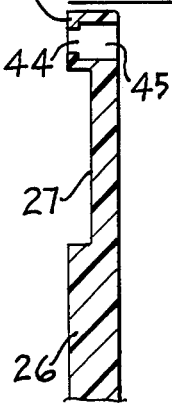
FIG. 7 is a vertical sectional view of the brace taken approximately on the line 7—7 of FIG. 6.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings, a heddle frame 10 is shown, of well known construction, comprising top and bottom rails 11, and side struts 12 connecting the ends of the rails 11 and maintaining them in spaced parallel relation. The side struts 12 can be held in engagement with the rails 11 in any desired manner.

The rails 11 are advantageously made of metal, can be of steel or of light weight metal alloys, such as those of aluminum or magnesium, with opposite parallel vertical side faces 14 and opposite inner and outer horizontal faces 15 and 16.

The heddle frame 10 is shown as having mounted therein upper and lower heddle supporting rods 17, of continuous or of sectional construction and which may be held at their ends by spring clips 19 carried on the side struts 12, and engaged in T-shaped apertures 20 in the ends of the rods 17. The heddle supporting rods 17 support a plurality of heddles 21 having central warp eyes 22 for controlling the shed.

The foregoing structure is known but has been included in aid in understanding the invention.

In accordance with the invention, one or more struts or braces 25 are provided, disposed intermediate the side struts 12, the number being determined by the width of the frame 10, the rigidity of the rails 11, and the loading applied by the warp.

Each brace 25 includes a pair of like body portions 26 to provide a brace 25 which is substantially rectangular in horizontal cross section.

Each body portion 26 has a groove or slot 28 spaced inwardly from each end for the reception therein of one of the heddle supporting rods 17 with half the thickness of each rod 17 being disposed within one of the grooves or slots 28.

Each body portion 26 also has a groove or slot 27 spaced inwardly from each end for the reception therein of one of the frame rails 11 with half the thickness of each rail 11 being disposed within one of the grooves or slots 27.

In order to secure the brace 25 on the top and bottom rails 11 attaching structure is provided, preferably including meeting faces 29 and 30 beyond the grooves 27.

The face 29 is preferably provided with projecting parts of snap type connections shown as a pair of projections 40 each having a central opening 41 therethrough with an enlarged outer end 42 with a transverse slot 43 providing bifurcated portions with rounded surfaces and the face 30 has openings 44 with larger diameter openings 45 therebeyond for engagement therein of the projections 40. The body portions 26 are the same, one being positioned with the projections 40 at the top and the other with the openings 44 at the top.

With the body portions 26 engaged at the grooves 28 with the heddle rods 17 and engaged at the grooves 27 with the frame rails 11 the brace can be easily locked in place by engaging the projections 40 in openings 44 and 45 where they are retained in locked position to hold the brace 25 in place.

The surfaces of the enlarged ends 42 act as cams and facilitate insertion for locking. The body portions 26 can be separated for removal of the brace 25, if desired.

The brace 25 in engagement at its ends with rails 11 and at desired locations between the side struts 12 will prevent distortion under load of the rails 11. The brace 25 is preferably of the same thickness as the side struts 12 so that upon movement to form a shed will avoid rubbing with the braces of adjoining frames.

The brace 25 can be made of a metallic material or a plastic synthetic resin of suitable toughness, resiliency, freedom from tendency to soil the fabric being woven and low coefficient of friction when in contact with metal rails. Suitable plastic materials include nylon with or without glass fiber filling, Delrin and Valox. If the brace 25 is of metal or plastic synthetic resin the body portion 26 can be adhesively secured together or held together with any desired type of fasteners.

I claim:

1. In a heddle frame having top and bottom frame rails and heddle supporting rods inwardly of said rails, the means for bracing said rails which comprises a brace extending between said rails and having separable portions with their ends in surrounding relation to and in engagement with said rails, said brace ends having sockets for engagement with said frame rails, said brace portions inwardly of said frame rails having sockets for engagement with said heddle supporting rails, and fastening members for retaining said separable portions in clamped engagement with said rails at a selected location intermediate the ends of the frame rails.

2. A heddle frame as defined in claim 1 in which said brace is of molded synthetic plastic.

3. A heddle frame as defined in claim 1 in which said brace has a central body portion, and said end portions are integral with said body portion.

4. A heddle frame as defined in claim 1 in which said end portions include a pair of like sections each of which is attachably connected to the other.

5. A heddle frame as defined in claim 4 in which said pair of sections each has fastening members outwardly beyond the frame rails for retaining said sections in assembled relation.

6. A heddle frame as defined in claim 5 in which a snap connector on one of said sections is in detachable engagement in an opening of another section.

7. A brace for heddle frames comprising a pair of like body sections having opposite end portions integral with said central body section, each of said end portions having a substantially rectangular opening for reception of a heddle frame rail, and each of said body sections having a substantially rectangular opening for the reception of a heddle supporting bar.

8. A brace as defined in claim 7 in which each of said opposite end portions includes a pair of faces for engagement with each other, and one of said sections has a fastening member detachably retaining said sections in engagement.

* * * * *